United States Patent [19]

Hilfiker

[11] Patent Number: 4,992,005

[45] Date of Patent: Feb. 12, 1991

[54] LIFTING DEVICE AND METHOD FOR RETAINING WALL PANELS

[76] Inventor: William K. Hilfiker, P.O. Box 2012, Eureka, Calif. 95501

[21] Appl. No.: 462,222

[22] Filed: Jan. 9, 1990

[51] Int. Cl.[5] ..... E02D 29/02; B66C 1/66

[52] U.S. Cl. ..... 405/284; 52/125.2; 294/89; 405/286

[58] Field of Search ..... 405/258, 262, 284, 285, 405/286; 52/122.1, 124.1, 124.2, 125.1–125.6; 248/220.1, 220.2, 222.1, 224.3; 294/81.1, 81.5, 89

[56] References Cited

U.S. PATENT DOCUMENTS

| | | | |
|---|---|---|---|
| 2,589,954 | 3/1952 | Neil | 294/89 X |
| 3,863,975 | 2/1975 | Oldenettel | 294/89 |
| 3,913,287 | 10/1975 | Chapman | 52/125.4 X |
| 4,088,361 | 5/1978 | Ditcher | 294/89 |
| 4,564,316 | 1/1986 | Hunziker | 405/262 |
| 4,627,198 | 12/1986 | Francies | 52/125.5 |

FOREIGN PATENT DOCUMENTS

| | | | |
|---|---|---|---|
| 564519 | 1/1924 | France | 405/286 |
| 7601471 | 8/1976 | Netherlands | 405/286 |

*Primary Examiner*—David H. Corbin

*Attorney, Agent, or Firm*—Limbach, Limbach & Sutton

[57] ABSTRACT

A lifting attachment for use with a retaining wall panel for earthen formations. The attachment comprises intersecting plates adapted to complementally engage the top and side surfaces of the panel. A fixed pin on one plate is receivable in an opening provided in the side surface of the panel. A removable pin is extensible through the other plate into an opening formed in the top surface of the panel.

9 Claims, 1 Drawing Sheet

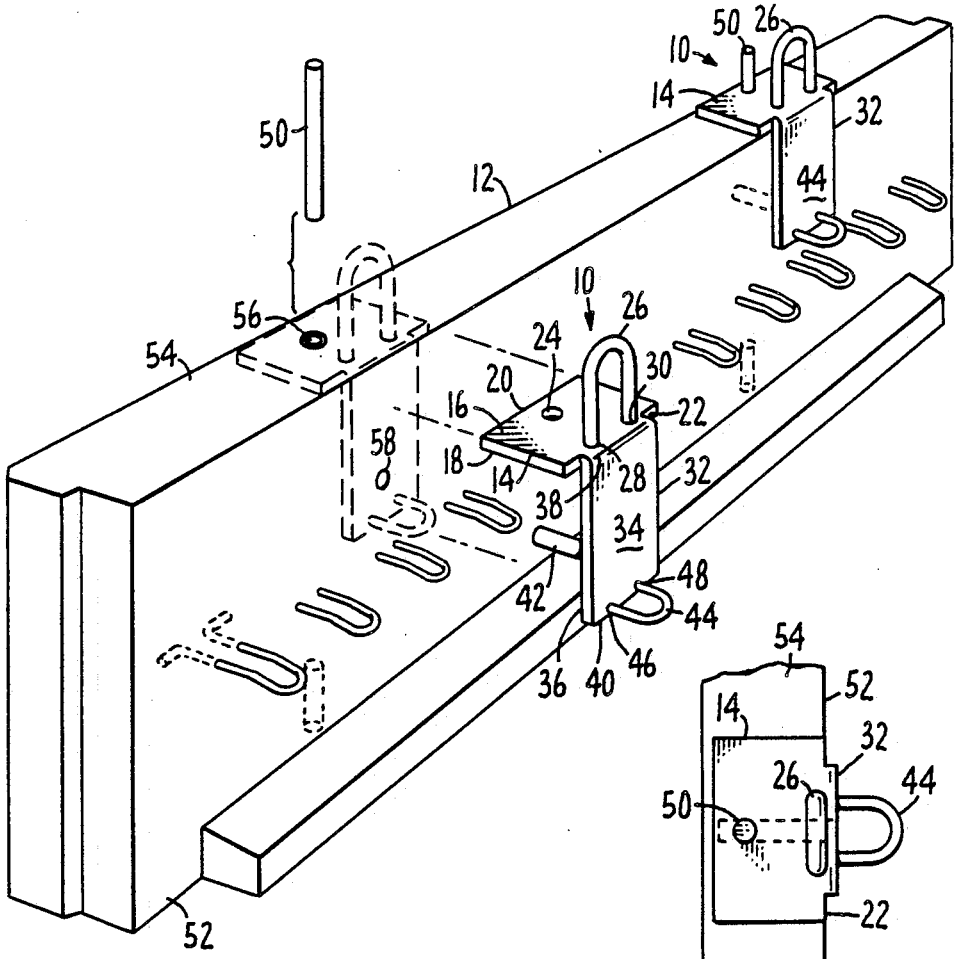
FIG. 1.
FIG. 2.
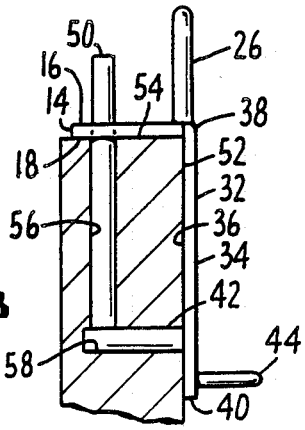
FIG. 3

LIFTING DEVICE AND METHOD FOR RETAINING WALL PANELS

RELATED APPLICATION

This application relates to my co-pending application Ser. No. 320,630, filed Oct. 30, 1989, now U.S. Pat. No. 4,929,125, in that it is concerned with a lifting device which may be used with the retaining wall panel of that application.

BACKGROUND OF THE INVENTION

There are many applications for retaining wall structures, many of which require stacking of retaining wall panels, and all of which require loading and unloading of the retaining wall panels for transport and storage. Due to the size and weight of retaining wall panels, loading and stacking of the panels is no small endeavor. Whether a panel is lifted by a forklift or is wrapped in cables and lifted by a crane, the potential exists for the panel to shift from the grip of the lifting device, thereby posing a threat of human injury, of damage of machinery and of damage to the panel itself.

In most instances, time is of essence and it is desirable to safely and expediently lift the retaining wall panel into place. What is more, there are times when the location where the retaining wall panel is to be placed is inaccessible by heavy equipment, save for the boom of a crane or derrick. Therefore, it is desirable to develop a device that is easily attached to the retaining wall panel that will permit the panel to be hoisted by cable into place in a timely fashion while reducing the risk of injury and damage.

SUMMARY OF THE INVENTION

The present invention relates to a lifting device and method that will allow for lifting and stacking retaining wall panels to permit placement into storage, placement onto transit equipment, creation of a retaining wall.

It is therefore an object of the present invention to provide a safe and secure means for lifting the retaining wall panel quickly into place, while substantially reducing the risk of injury to workers, damage to machinery, and damage to the retaining wall panel itself.

It is also an object of the present invention to provide a lifting device for retaining wall panels that can be quickly and easily attached to, or detached from, a retaining wall panel.

It is another object of the invention to provide a lifting device for retaining wall panels that can be constructed from durable, inexpensive materials.

It is a further object of the invention to provide a means by which a retaining wall panel can be quickly and easily modified to permit attachment of the invention to the retaining wall.

It is yet another object of the invention to provide a lifting device that can be securely attached to a retaining wall panel with a minimum of modification to the panel.

BRIEF DESCRIPTION OF THE DRAWINGS

In the drawings that illustrate preferred embodiments of the invention:

FIG. 1 is a perspective view of a retaining wall panel that has been modified so as to be fitted with the lifting device;

FIG. 2 is a plan view of a segment of a retaining wall panel to which the lifting device has been attached;

FIG. 3 is a cross-sectional elevation view of a retaining wall panel at the point where the lifting device has been attached.

DESCRIPTION OF THE ILLUSTRATED EMBODIMENTS

Illustrated in FIG. 1 is a method for attaching a lifting device 10 to a retaining wall panel 12 of the type shown in application Ser. No. 320,630 that has been modified so as to permit attachment of the lifting device 10. Although typical of the type of panel to which the device may be attached, the invention is not limited to use with this specific panel. A top plate 14 is shown to have a rectangular configuration, and has a top surface 16, a bottom surface 18, a first longitudinal edge 20 and a second longitudinal edge 22. A plate aperture 24 is longitudinally centered along the top plate 14, is displaced along the width of the top plate 14 so as to be located closer to the first longitudinal edge 20 that to the second longitudinal edge 22, runs through the top plate 14 and has an axis perpendicular to the plane of the top plate 14. A lifting bail 26, being U-shaped and having a first end 28 and a second end 30, is attached to the top surface 16 such that the line intersecting the first end 28 and the second end 30 is parallel and proximate to the second longitudinal edge 22, and such that the plane containing the lifting bail 26 is perpendicular to that of the top plate 14.

A side plate 32 of the lifting device 10 is integrally joined to the plate 14 and of a rectangular configuration and has an outer surface 34, an inner surface 36, and upper longitudinal end 38 and a lower longitudinal end 40. A fixed cylindrical pin 42 is attached at one end to the inner surface 36 and extends away from the inner surface 36 such that the axis of the pin is perpendicular to the plane of the inner surface 36. A U-shaped aligning bail 44 of smaller over-all dimensions than the lifting bail 26, has a first end 46 and a second end 48. The aligning bail 44 is attached to the outer surface 34 such that the line intersecting the first end 46 and the second end 48 is parallel and proximate to the lower longitudinal end 40, and such that the plane containing the aligning bail 44 is perpendicular to the plane of the side plate 32.

The side plate 32 is perpendicular to the top plate 14 and parallel to the second longitudingal edge 22. The side plate 32 is attached to the top plate 14 is such a way that the side plate 32 is longitudinally centered along the second longitudinal edge 22, the entire area of the inner surface 36 leading perpendicularly away from the upper longitudinal end 38 for a distance equivalent to the width of the second longitudinal edge 22 and running the entire width of the inner surface 36 is proximate to the surface of the second longitudinal edge 22, and the upper longitudinal end 38 is flush with the top surface 16.

A removable attaching pin 50 is receivable in the aperture 24. The pin 50 is cylindrical, has a diameter slightly less than that of the plate aperture 24, and is of a length greater than the perpendicular distance between the top surface 16 and the lower-most surface of the fixed pin 42.

The retaining wall panel 12 has a face 52 and a top edge 54. The face 52 is of a height greater than the distance between the bottom surface 18 and the lower-most surface of the fixed pin 42, while the top edge 54 is of a width not less then than the distance between the first longitudinal edge 20 and the second longitudinal edge 22. The retaining wall panel 12 can easily be made capable of receiving the lifting device 10 by creating a first cylindrical cavity 56 and a second cylindrical cavity 58 in the retaining wall panel 12 at each location in the retaining wall panel 12 that a lifting device 10 is to be fastened to the retaining wall panel 12. The first cavity 56 is the same cavity used for the panel alignment pins used to maintain stacked panels in aligned relationship, as shown in application Ser. No. 320,630. The only difference between the panel 12 and that of said application is the provision of the second cavity 58 and the extension of the first cavity 56 into intersecting relationship with the cavity 58. The intersection of the cavities enables the cavity 58 to serve as a drain for the cavity 56.

The first cylindrical cavity 56 has a diameter substantially equivalent to that of the plate aperture 24 and extends into the retaining wall panel 12 from the top edge 54 such that: the depth of the first cylindrical cavity 56 is substantially equivalent to the perpendicular distance between the bottom surface 18 and the axis of the fixed pin 42, the axis of the first cylindrical cavity 56 is perpendicular to the plane of the top edge 54, and the perpendicular distance between the axis of the first cylindrical cavity 56 and the face 52 of the retaining wall panel 12 is substantially equivalent to the perpendicular distance between the axis of the plate aperture 24 and the second longitudinal edge 22.

The second cylindrical cavity 58 has a diameter slightly larger than that of the fixed pin 42, and extends into the retaining wall panel 12 away from the face 52 for a distance that is not less than the length of the fixed pin 42 such that the axis of the second cylindrical cavity 58 is perpendicular to the plane of the face 52 and such that the axis of the second cylindrical cavity 58 will intersect the axis of the first cylindrical cavity 56.

Looking at FIG. 2, it can be seen that when the lifitng device 10 is properly attached to the retaining wall 12 and the removable pin 50 is inserted through the plate aperture 24 annd into the first cylindrical cavity 56, the axis-line of the removable pin 50 intersects of the axis-line of the fixed pin 42.

FIG. 3 shows what when the fixed pin 42 is inserted into the second cylindrical cavity 58 so that the top plate 14 becomes located above the top edge 54 and the removable pin 50 is inserted through the plate aperture 24 and into the first cylindrical cavity 56, the axis of the fixed pin 42 is perpendicular to the axis of the removable pin 50. It can also be seen from FIG. 3 that when the lifting device 10 is properly attached to the retaining wall panel 12, the inner surface 36 will be proximate and parallel to the face 52 of the retaining wall panel 12, and the bottom surface 18 will be proximate and parallel to the top edge 54 of the retaining wall panel 12.

From these figures it becomes clear that the lifting device 10 can easily be attached to the retaining wall panel 12 by using the lifting bail 26 as a handle by which to lift the lifting device 10 into close proximity with the retaining wall panel 12, by using the aligning bail 44 to align the fixed pin 42 with the second cylindrical cavity 58, and by inserting the fixed pin 42 into the second cylindrical cavity 58 until the plate aperture 24 aligns with the first cylindrical cavity 56. The lifting device 10 can then be easily secured to the retaining wall panel 12 by inserting the removable pin 50 through the plate aperture 24 and into the first cylindrical cavity 56. The lifting bail 26 now provides a means through which a cable or similar device may be threaded and fastened, thereby allowing the retaining wall panel 12 to be lifted into place by a derrick or a crane.

The device 10 may be removed from the panel by simply removing the pin 50 and pulling on the bail 44. It should be appreciated that two or more such lifting devices are used on elongated panels, as shown in FIG. 1, and that the devices are reusable.

In a typical embodiment the plates 14 and 32 are made of ½ inch steel plate and welded together at their adjoining edges. The exact dimensions of the plates, pins and bails will depend on the size of the panels with which the device 10 is designed to be used. In one example, the top plate 14 measures six inches by four inches, the side plate 32 measures eight and one half inches by four inches, the pin 42 measures four inches in length and seven eighths inches in diameter, the lifting bail 26 is made of one half inch steel rod welded to the plate 14 and the bail 44 is made of one quater inch steel rod welded to the plate 32.

Although preferred embodiments of the invention have been illustrated and described, it should be understood that the invention is not intended to be limited to the specifics of these embodiments, but rather is defined by the accompanying claims.

I claim:

1. A lifting device for a retaining wall panel of the type having top and side surfaces, said device comprising:

(a) first and second plates connected for complemental engagement with the top and side surfaces, respectively, of the panel;

(b) a pin extending from each of said plates for engagement in a cavity formed in the surface of a panel complementally engaged by the plate to secure the plates to the panel; and, (c) hoist engageable means carried by one of said plates for applying lifting force to the plate and a panel secured thereto.

2. A lifting device according to claim 1 wherein:

(a) the plates are integrally connected;

(b) the pin extending from the first plate is removable to facilitate securing of the plates to a panel and removal of the plates from the panel; and, (c) the pin extending from the second plate is fixed thereto.

3. A lifting device according to claim 1 or 2 wherein the hoist engageable means comprises a bail secured to the first plate.

4. A lifting device according to claim 3 further comprising aligning means secured to the second plate to facilitate engagement of the plate with and removal of the plate from a panel.

5. A lifting device according to claim 4 wherein the aligning means comprises a bail fixed to the second plate.

6. A method of lifting a retaining wall panel of the type having top and side surfaces, said method comprising:

(a) providing elongate cavities extending through the top side surfaces of the panel;

(b) providing a bracket having first and second plates connected for complemental engagement with the top and side surfaces, respectively, of the panel;

(c) engaging the bracket with the panel so as to position said first and second plates in complemental engagement with the top and side surfaces of the panel and over the elongate passages extending through said surfaces; and, (d) securing said bracket to the panel by pins extending from the first and second plates and into the elongate passages.

7. A method according to claim 6 further comprising providing a lifting bail on the first plate.

8. A method according to claim 7 further comprising providing an aligning element on the second to facilitate application of the bracket to and removal of the bracket from a panel.

9. A lifting device comprising:

a top plate, a side plate, and a removable pin, such that the top plate is perpendicular to the side plate and such that the one edge of the top plate is affixed to one edge of the side plate, and wherein the top plate includes a top surface, a bottom surface, a plate aperture running throughout the top plate and having an axis perpendicular to the plane of the top plate, and a lifting bail affixed to the top surface and contained in a plane perpendicular to that of the top plate, and wherein the side plate includes and outer surface, an inner surface, a fixed pin perpendicular to the side plate and attached at one end to the inner surface, and an aligning bail fastened to the outer surface and residing in a plane perpendicular to that of the side plate, and wherein the removable pin is of a diameter such that it may be received within the plate aperture.

* * * * *